United States Patent [19]

Hoeptner, III

[11] Patent Number: 4,951,723

[45] Date of Patent: Aug. 28, 1990

[54] MOTORCYCLE ENGINE OIL DRAIN PLUG

[75] Inventor: Herbert W. Hoeptner, III, Morgan Hill, Calif.

[73] Assignee: Custom Chrome, Inc., Morgan Hill, Calif.

[21] Appl. No.: 416,376

[22] Filed: Oct. 2, 1989

[51] Int. Cl.[5] ..... B65B 3/04; F16N 1/00; F01M 11/04

[52] U.S. Cl. ..... 141/351; 141/346; 141/348; 141/349; 141/98; 141/65; 184/1.5

[58] Field of Search ..... 141/98, 65, 346, 348–354, 141/357, 382, 383, 384, 386; 184/105.1

[56] References Cited

U.S. PATENT DOCUMENTS

| | | | |
|---|---|---|---|
| 1,509,327 | 9/1924 | Winchester | 184/1.5 X |
| 1,659,047 | 2/1928 | Quinn | 184/1.5 X |
| 1,818,122 | 8/1931 | Engbrecht | 184/1.5 |
| 1,846,877 | 2/1932 | Knapp | 184/1.5 X |
| 3,035,617 | 5/1962 | Breitenstein | 141/349 |
| 3,387,621 | 6/1968 | Schaff | 184/1.5 X |
| 3,486,730 | 12/1969 | Potash | 141/346 |
| 3,635,264 | 1/1972 | Milburn | 141/348 X |
| 3,720,287 | 3/1973 | Martel | 184/1.5 |
| 4,025,048 | 5/1977 | Tibbitts | 184/1.5 X |
| 4,269,237 | 5/1981 | Berger | 141/346 |
| 4,386,639 | 6/1983 | Gable et al. | 141/351 |
| 4,530,421 | 7/1985 | Balch | 184/1.5 |
| 4,637,441 | 1/1987 | Gomersall | 141/349 |
| 4,745,894 | 5/1988 | Laipply et al. | 184/1.5 X |
| 4,776,430 | 10/1988 | Rule | 184/1.5 |

FOREIGN PATENT DOCUMENTS

| | | | |
|---|---|---|---|
| 229612 | 10/1963 | Austria | 141/348 |
| 1372285 | 10/1963 | France | 141/349 |
| 8602161 | 3/1988 | Netherlands | 184/1.5 |
| 953513 | 3/1964 | United Kingdom | 141/348 |
| 1104422 | 2/1968 | United Kingdom | 141/349 |

*Primary Examiner*—Ernest G. Cusick
*Attorney, Agent, or Firm*—William W. Haefliger

[57] ABSTRACT

A tank oil drain device comprises a drain receptacle associated with the tank, the receptacle defining a bore having a mouth opening to the tank exterior, the receptacle having a first port communicating between the tank interior and the bore; a plunger received in the bore, and a spring urging the plunger toward a position in the bore in which the first port is blocked; a seal normally sealing off between the bore and the side of the plunger at a location between the first port and the mouth; and lock structure carried by the receptacle, near the mouth, for retaining a tubular drain plug pushed into the bore for displacing the plunger in the bore sufficiently to unblock the first port thereby establishing oil draining communication via the first port and the plug to the exterior. The first port remains blocked by the plunger while the seal engages and seals off about the drain plug through a predetermined range of movement of the drain plug in the bore. Also, a shoulder on the receptacle is in axially spaced relation to the first port and the seal for seating the plunger in the bore in the initial position in which the plunger blocks the first port.

7 Claims, 2 Drawing Sheets

MOTORCYCLE ENGINE OIL DRAIN PLUG

BACKGROUND OF THE INVENTION

This invention relates generally to drain plugs, and more particularly concerns a drain assembly attached to a tank, such as an engine crankcase housing, for enabling ready drainage of liquid such as oil from the tank, without spillage.

When drain plugs are removed from engine crankcase housings, oil immediately spills out in a solid stream, and if the plug momentarily interferes with the escaping stream as the plug is removed, splashing and spilling of oil results. Also, when a waste oil receptacle tank is positioned directly under the crankcase drain, oil can spill uncontrollably. There is need for an improved, simple oil drainage means, overcoming these problems.

SUMMARY OF THE INVENTION

It is a major object of the invention to provide an improved, highly effective, oil drain device which prevents unwanted oil spillage, and allows controlled drainage of oil (or liquid) from the tank or crankcase. As will be seen, the device basically comprises:

(a) a drain receptacle associated with the tank, the receptacle defining a bore having a mouth opening to the tank exterior, the receptacle having a first port communicating between the tank interior and said bore, (b) a plunger received in said bore, and a spring urging the plunger toward a position in the bore in which said first port is blocked, (c) a seal means normally sealing off between the bore and plunger at a location between said first port and said mouth, and (d) lock means carried by the receptacle, near said mouth, for retaining a tubular drain plug pushed into the bore for displacing the plunger in said bore sufficiently to unblock said first port thereby establishing oil draining communication via said first port and said plug to the exterior.

As will appear, the tubular plug may be received in the tubular receptacle bore to have rotary tongue and groove interconnection; and the forward nose of the plug may be perforated to pass oil from the tank and port into the plug, despite its rotation to achieve rotary locking.

Further, the plug may be configured to interfit the plunger end, whereby the plug is centered in the tubular receptacle as it enters and reaches fully installed position in the receptacle.

In use, the plug is easily pushed into the receptacle to quickly establish oil drainage, via the plug nose and bore, to a hose which leads the oil to a waste oil tank at another location. After oil drainage is completed, the disconnection of the plug is achieved simply by rotatably unlocking the plug from the receptacle head, the compressed spring then ejecting the plug, and the plunger automatically re-establishing the sealed blockage of oil escape, via the plunger.

These and other objects and advantages of the invention, as well as the details of an illustrative embodiment, will be more fully understood from the following specification and drawings, in which:

DESCRIPTION OF THE PREFERRED EMBODIMENT

Figure 1:
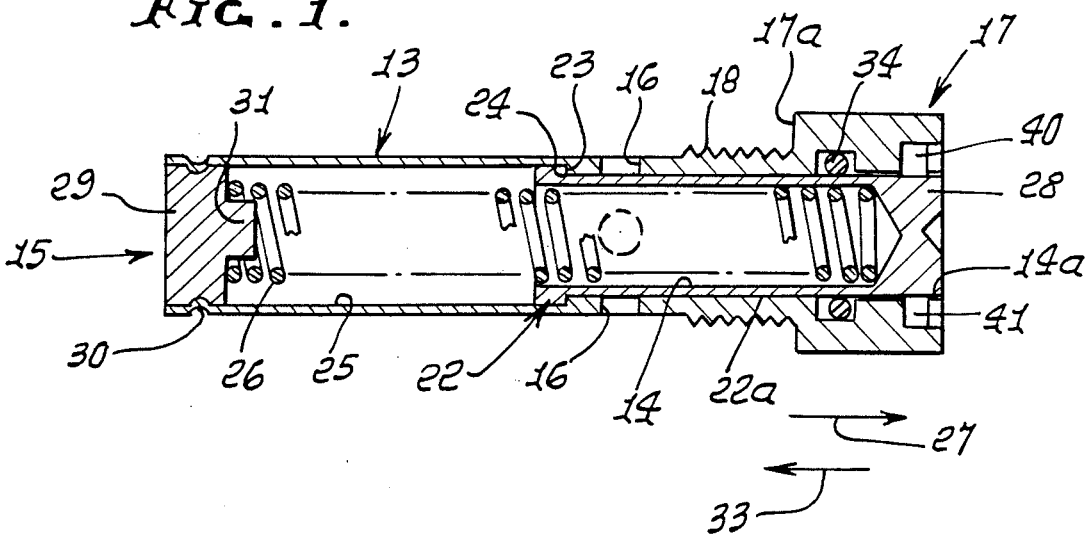
FIG. 1 is an elevation in section showing a drain control device incorporating the invention.
Figure 2:
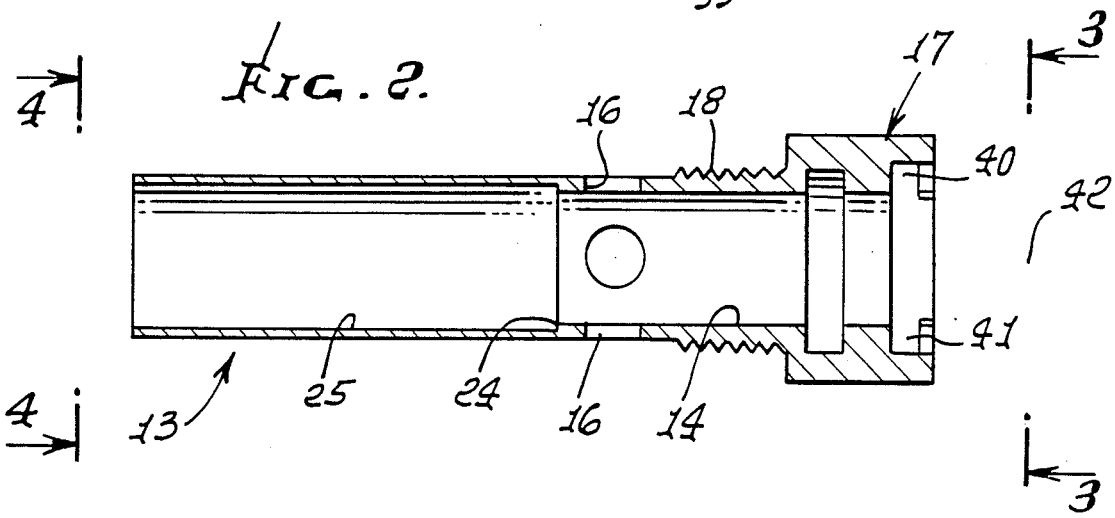
FIG. 2 is a section in elevation showing the receptacle.
Figure 4:
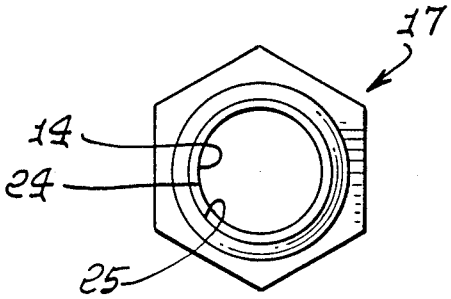
FIG. 4 is an end view taken on lines 4—4 of FIG. 2.
Figure 3:
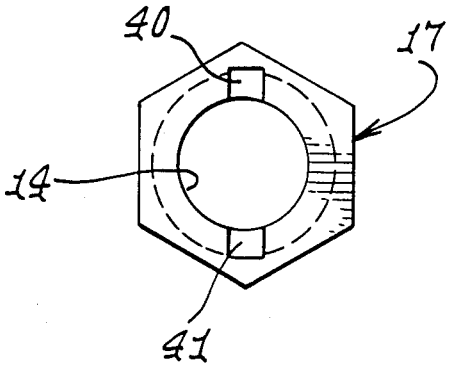
FIG. 3 is an end view taken on lines 3—3 of FIG. 2.
Figure 5:
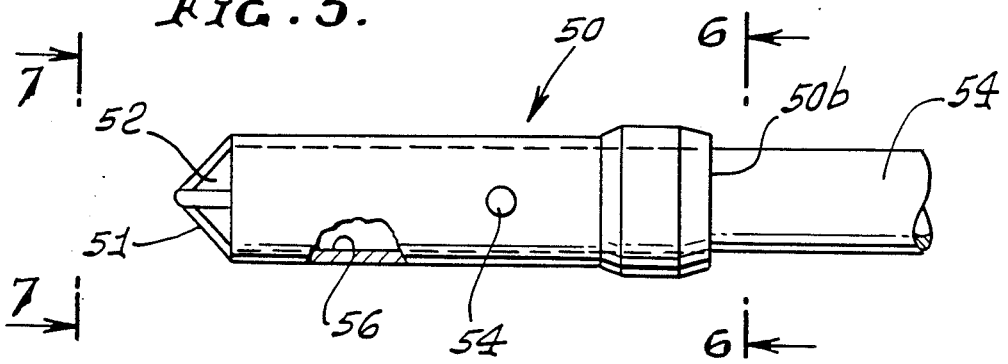
FIG. 5 is a side elevation showing a drain plug connectable to the receptacle and plunger of the invention.

In the drawings a tank is shown at 10, and may contain lubricating oil 11. It may for example comprise a vehicle transmission housing defining a sump for lubricating oil. Tank wall 12 contains a through opening via which oil is to be drained from the tank. That opening is defined by internal thread 19.

A drain receptacle is associated with the tank, and may take the form of a tubular body 13 defining a bore 14 having a mouth at 14*a* opening to the tank exterior. The opposite end of body 13 is closed at 15. Body 13 has one or more side wall through openings or ports 16 which communicate with oil in the tank, for draining such oil to the interior of the body, for outflow via mouth 14*a*. The body has a head 17 which defines a shoulder 17*a* seating against wall 12, when the body thread 18 is screwed into the tank thread 19. 0-ring seal 20 seals off against the body exterior, as shown.

A plunger 22 is received in the body bore 14, and is shown in the form of a tube having an exterior surface 22*a* slidable in the bore 14. A shoulder 23 at the inward end of the tube engages a shoulder 24 defined between body bore 14 and body counterbore 25 to limit travel of the tube toward the mouth 14*a*. Coiled compression spring 26 urges the plunger in the direction of arrow 27, and is confined between head 28 on the plunger, and a plug 29 retained at 30 at the inner end of the body 13. Note boss 31 on the plug and centering the end of the spring. As the plunger is displaced inwardly, in the direction of arrow 33, the spring is increasingly compressed. An 0-ring seal 34 in head 17 seals off between the head and the outer cylindrical surface of the plunger. That seal is located between port or ports 16 and mouth 14*a* to prevent escape or leakage of oil to the exterior, from the clearance between bore 14 and the plunger outer surface.

Figure 7:
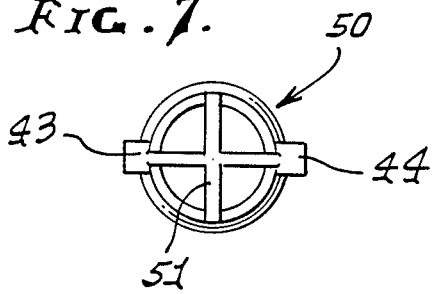
FIG. 7 is an end view taken on lines 7—7 of FIG. 5.
Figure 6:
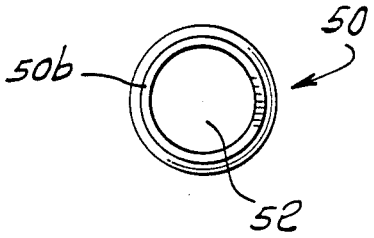
FIG. 6 is an end view taken on lines 6—6 of FIG. 5.

Lock means is carried by the receptacle, near said mouth, for retaining a tubular drain plug pushed into the bore for displacing the plunger in said bore sufficiently to unblock said first port thereby establishing oil draining communication via said first port and said plug to the exterior. As shown, the lock means on the receptacle comprises two grooves 40 and 41 which extend radially from bore 14 into the head 17 near mouth 14*a*. The grooves also extend circumferentially for, say between 5 and 10 degrees about plunger axis 42, in undercutting spaced relation from the end 17*a* of the head. The grooves are adapted to receive tongues 43 and 44 projecting radially, i.e. trunnions, from the outer cylindrical surface of the tubular plug 50 seen in FIGS. 6–8. Accordingly, a releasable, rotary lock is established to hold the plug in inserted position seen in FIG. 8.

Figure 8:
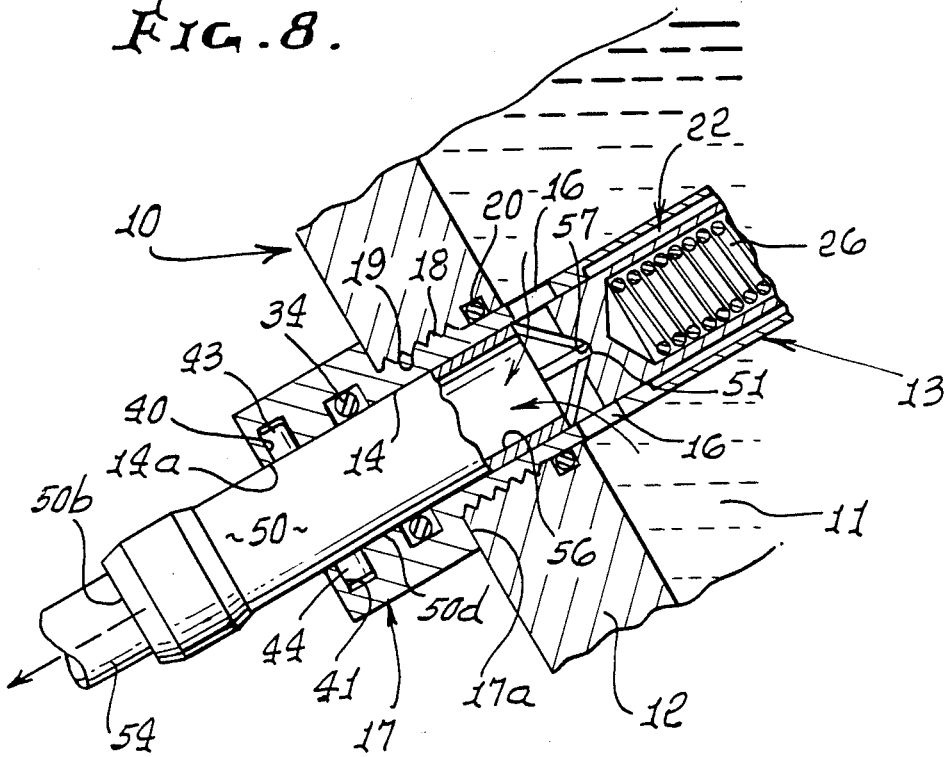
FIG. 8 is an assembly view showing, in sections, the plug inserted into and locked to the receptacle and plunger.

Note in FIG. 8 that the plug 50 fits closely within the bore 14, and has a tapered nose at 51 to engage and push or displace the plunger forwardly in the bore 14, beyond the ports 16. In locked position, the plug forward end portion, which is perforated, passes oil draining from the tank interior into the plug interior 52, and then outwardly via plug end 50*b* and flexible hose 54 attached to the plug. In FIG. 8, the plug outer surface 50*d* is engaged by the 0-ring seal 34.

FIG. 8 also shows the tapered nose 51 received in tapered recess 57 in the head 28 of the body, providing for centering of the plug in bore 14. The plug bore is indicated at 56 as is clear from the drawings, the first port 16 remains blocked by the plunger 22 while the seal 34 engages and seals off about the drain plug 50 through a predetermined range of movement of the draining plug in the bore 14. The shoulder 24 on the receptacle 13 is in axially spaced relation to said first port 16 and the seal 34 for seating said plunger in said bore in an initial position in which the plunger blocks the first port.

I claim:

1. A tank oil drain device, comprising (a) a tank, and a drain receptacle including a tubular body associated with the tank, the receptacle defining a bore having a mouth opening to the tank exterior, the tubular body having a sidewall defining a first port communicating between the tank interior and said bore, (b) a tubular plunger received in said bore, and a spring urging the plunger toward a position in the bore in which said first port is blocked, and a drain plug receivable in said bore, (c) a seal means normally sealing off between the bore and plunger at a location between and spaced from said first port and said mouth, and until the drain plug is received sufficiently into the bore to displace the plunger beyond the seal means, the plunger beyond the seal means, (d) lock means carried by the receptacle, near said mouth, for retaining said tubular drain plug pushed into the bore for displacing the plunger in said bore sufficiently to unblock said first port thereby establishing oil draining communication via said first port and said plug to the exterior, said first port remaining blocked by the plunger while the seal means engages and seals off about the drain plug through a predetermined range of movement of the drain plug and plunger in said bore, (e) and a shoulder on the receptacle in axially spaced relation to said first port and said seal means for seating said plunger in said bore in an initial position in which the plunger blocks said first port.

2. The combination of claim 1 wherein said plug and lock means have rotary tongue and groove interconnection.

3. The combination of claim 1 wherein said receptacle in tubular and has exterior threading for threaded attachment to the tank.

4. The combination of claim 1 wherein said plug has a tapered nose to engage and push the plunger into the bore, said nose being perforated to pass oil draining from said first port into the tubular plug.

5. The combination of claim 4 wherein said tapered nose is adjacent said first port, when the plug and receptacle are in locked condition.

6. The combination of claim 1 wherein said plug received in said bore has an outer surface engaged by said seal means.

7. The combination of claim 1 wherein a flexible discharge hose is connected with the plug.

* * * * *